US011033793B2

(12) United States Patent
Smith

(10) Patent No.: US 11,033,793 B2
(45) Date of Patent: Jun. 15, 2021

(54) GOLF TRAINING DEVICE

(71) Applicant: Stance Caddy LLC, Seattle, WA (US)

(72) Inventor: Brian Smith, Seattle, WA (US)

(73) Assignee: Stance Caddy LLC, Seattle, WA (US)

( * ) Notice: Subject to any disclaimer, the term of this patent is extended or adjusted under 35 U.S.C. 154(b) by 0 days.

(21) Appl. No.: 16/941,431

(22) Filed: Jul. 28, 2020

(65) Prior Publication Data

US 2021/0038963 A1 Feb. 11, 2021

Related U.S. Application Data

(60) Provisional application No. 62/883,038, filed on Aug. 5, 2019.

(51) Int. Cl.
*A63B 69/36* (2006.01)
*A63B 71/06* (2006.01)

(52) U.S. Cl.
CPC ..... *A63B 69/3667* (2013.01); *A63B 69/3608* (2013.01); *A63B 71/06* (2013.01); *A63B 2071/0694* (2013.01); *A63B 2210/50* (2013.01)

(58) Field of Classification Search
USPC ..... 473/218, 257, 272, 273, 266, 409
See application file for complete search history.

(56) References Cited

U.S. PATENT DOCUMENTS 4,322,084 A * 3/1982 Reece ..... A63B 69/3667 473/273
4,384,718 A * 5/1983 Cachola ..... A63B 69/3667 473/218
4,718,674 A * 1/1988 Henry ..... A63B 69/3667 473/218
5,110,132 A 5/1992 Weston et al.
5,415,407 A 5/1995 Beatty
5,464,220 A * 11/1995 Hansen ..... A63B 69/3667 473/218
6,077,168 A 6/2000 Huang
6,106,408 A * 8/2000 Roman ..... A63B 69/3667 473/217
6,669,575 B1 12/2003 Marlette
6,752,724 B1 6/2004 Schumacher
7,037,210 B2 5/2006 Bainter
7,261,640 B1 * 8/2007 Baggott ..... A63B 69/3667 473/270
7,575,522 B1 8/2009 Affrunti
7,927,227 B2 4/2011 Carpenter
8,021,242 B1 * 9/2011 Tennison ..... A63B 69/3667 473/218

(Continued)

*Primary Examiner* — Nini F Legesse
(74) *Attorney, Agent, or Firm* — Klemchuk LLP

(57) ABSTRACT

A golf training device may aid both left and right-handed golfers to ensure proper stance width using a numbering system based on shoulder width. The training device may ensure proper ball placement off the golfer's front heel to ensure consistent ball striking location in swing. The training device may further ensure proper front foot angle along a swing path for full, pitching, and/or chipping swings and proper rear foot offset from the target line and stance width to ensure consistent swing arch based on the selected club. The training device may be flipped over depending on which hand the golfer uses, and it may be separated or collapsed to be placed in the golfer's bag for storage and/or transport.

15 Claims, 4 Drawing Sheets

(56) References Cited

U.S. PATENT DOCUMENTS

| | | | | |
|---|---|---|---|---|
| 8,834,287 | B1 * | 9/2014 | Reid | A63B 69/3667 473/266 |
| 8,951,140 | B1 | 2/2015 | Kim | |
| 9,636,564 | B1 | 5/2017 | Arnold | |
| 2002/0111224 | A1 | 8/2002 | Sweinhart | |
| 2003/0220151 | A1 | 11/2003 | Bainter | |
| 2007/0135226 | A1 | 6/2007 | Henderson | |
| 2013/0178302 | A1 | 7/2013 | Shahi et al. | |
| 2014/0121033 | A1 * | 5/2014 | Maddox | A63B 57/10 473/257 |
| 2015/0217175 | A1 | 8/2015 | Carson et al. | |

* cited by examiner

GOLF TRAINING DEVICE

CROSS-REFERENCE TO RELATED APPLICATION

The present Application is a non-provisional of, and claims priority to, U.S. Patent Application No. 62/883,038, filed Aug. 5, 2019, and is incorporated by reference herein in its entirety.

FIELD OF THE DISCLOSURE

The present disclosure generally relates to golf training devices, and more particularly to golf stance, ball position, and alignment training devices.

BACKGROUND

When playing golf, one's stance, ball position, and alignment may be important to create a repeatable and consistent swing. As described in *Ben Hogan's Five Lessons: The Modern Fundamentals of Golf*, a golf swing and instruction book, in the basic golf stance, the golfer's right foot should be at a right angle to the line of flight and the left foot should be turned out a quarter of a turn to the left. A golfer's feet should be set apart the width of the shoulders when the golfer prepares to play a standard five-iron shot. A neutral position for use of a five-iron club may be when both feet are inline vertically and horizontally, and both axes may be adjusted positively and negatively depending on how the club length is varied to open the hips to the target and reduce stance width for shorter irons, or close the hips to the target and increase stance width for longer irons, rescue clubs, or driver. To attempt to line up his/her feet, hips, and shoulders correctly, golfers may use tools, such as golf alignment sticks, but they suffer from drawbacks including that they provide no guidance where to place one's feet, neither how far apart they should be per club nor how offset from the target line they should be per club. Other tools may include the Swing Path Board, Practice Rite Golf, and WellStance Golf Positioning, but these tools include large boards or contraptions that are not portable and easy-to-use in golf training.

SUMMARY

A golf stance, ball position, and alignment training device according to embodiments of the present disclosure may be provided as a single piece or may be comprised of loose parts fastened together. Both left and right-handed golfers may use a golf training device according to embodiments of the present disclosure, as the device may be flipped over depending on which hand the golfer uses. Proper stance width may be enforced using a numbering system based on shoulder width. The training device according to embodiments of the present disclosure may ensure proper ball placement off the golfer's front heel to ensure consistent ball striking location in swing. The training device according to embodiments of the present disclosure may further ensure proper front foot angle along a swing path for full, pitching, and/or chipping swings and proper rear foot offset from the target line promoting a correct open, neutral, or closed stance and stance width to ensure consistent swing arch based on the selected club. The training device may be separated or collapsed to be placed in the golfer's bag for storage and/or transport in embodiments of the present disclosure.

Embodiments of the present disclosure may provide a golf training device comprising: a first horizontal bar having a first end and a second end, the second end having a first pivot point; a second horizontal bar having a first end and a second end, the first end having a second pivot point, the second horizontal bar further comprising a measurement window movable between the first end and the second end to set a golf stance width based on shoulder width of a golfer; and an alignment bar attached to the first horizontal bar at the first pivot point on a lower half portion of the alignment bar and attached to the second horizontal bar at the second pivot point on a top half portion of the alignment bar, wherein the first pivot point and the second pivot point may collapse the golf training device for storage/transport when not in use. The first horizontal bar may further comprise a front foot visual aid at the first end to provide for foot and foot angle placement and/or a front foot visual aid between the first end and the second end to provide for foot and foot angle placement. The alignment bar may further comprise marks on the lower half portion of the alignment bar for a golfer to increase an open stance when using wedges and short irons or decrease a closed stance when using fairway woods or a driver. The alignment bar also may include marks on a top end of the alignment bar, thereby providing an indication where the golfer may place a golf ball. The golf training device may further comprise marks on a bottom end of the alignment bar and a top of the measurement window to use when the golf training device is extended in a measurement mode. The marks on the bottom end of the alignment bar may be placed up to the golfer's shoulders with the marks resting on an outside of one shoulder and the marks at the top of the measurement window resting on an outside of an alternate shoulder of the golfer. The golf training device may also include marks on the first end of the first horizontal bar and the second end of the second horizontal bar to insert golf tees to secure the golf training device to a surface. The golf training device may further include a rear foot bar attached to the second horizontal bar, the rear foot bar having a first end and a second end, wherein the rear foot bar is capable of being extended to promote correct placement of a rear foot of the golfer relative to his/her club. The rear foot bar may include a pivot point at the first end that provides a connection point between the rear foot bar and the measurement window and/or marks between the first end and the second to identify correct heel placement for wedges (W), short irons (7i), mid irons (5i), fairway woods (3w), and drivers (D). The measurement window may move horizontally along the second horizontal bar to set the shoulder width. The golf training device may include marks between the first end and the second end of the second horizontal bar that depict a measurement setting to ensure golfer stance width is properly set. The pivot points may be fastened with a mechanism to provide spring-loaded stop points to ensure proper angles when the golf training device is collapsed and expanded. Marks may be on both sides of the first horizontal bar, the second horizontal bar, the alignment bar, and the rear foot bar so that the golf training device may be flippable for use by both right and left-handed golfers.

Other embodiments of the present disclosure may provide a golf training device comprising: a first horizontal bar having a first end and a second end, the second end having a first pivot point; a second horizontal bar having a first end and a second end, the first end having a second pivot point, the second horizontal bar further comprising a measurement window movable between the first end and the second end to set a golf stance width based on shoulder width of a golfer; an alignment bar attached to the first horizontal bar at the first pivot point on a lower half portion of the alignment bar and attached to the second horizontal bar at the second pivot point on a top half portion of the alignment bar; and marks on a bottom end of the alignment bar and a top of the measurement window to use when the golf training device is extended in a measurement mode. Marks on the bottom end of the alignment bar may be placed up to the golfer's shoulders with the marks resting on an outside of one shoulder and the marks at the top of the measurement window resting on an outside of an alternate shoulder of the golfer.

Further embodiments of the present disclosure may provide a golf training device comprising: a first horizontal bar having a first end and a second end, the second end having a first pivot point; a second horizontal bar having a first end and a second end, the first end having a second pivot point, the second horizontal bar further comprising a measurement window movable between the first end and the second end to set a golf stance width based on shoulder width of a golfer; an alignment bar attached to the first horizontal bar at the first pivot point on a lower half portion of the alignment bar and attached to the second horizontal bar at the second pivot point on a top half portion of the alignment bar; and a rear foot bar attached to the second horizontal bar, the rear foot bar having a first end and a second end, wherein the rear foot bar is capable of being extended to promote correct placement of a rear foot of the golfer relative to his/her club. The rear foot bar may further comprise a pivot point at the first end that may provide a connection point between the rear foot bar and the measurement window. The rear foot bar also may include marks between the first end and the second to identify correct heel placement for wedges (W), short irons (7i), mid irons (5i), fairway woods (3w), and drivers (D).

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a golf training device may aid both left and right-handed golfers to ensure proper stance width using the shoulder width as measured with the golf training device. The training device according to embodiments of the present disclosure may ensure proper ball placement off the golfer's front heel to ensure consistent ball striking location in swing. The training device according to embodiments of the present disclosure may further ensure proper front foot angle along a swing path for full, pitching, and/or chipping swings and proper rear foot offset from the target line and stance width to ensure consistent swing arch based on the selected club. The training device may be flipped over depending on which hand the golfer uses, and it may be separated or collapsed to be placed in the golfer's bag for storage and/or transport in embodiments of the present disclosure.

Figure 3A:
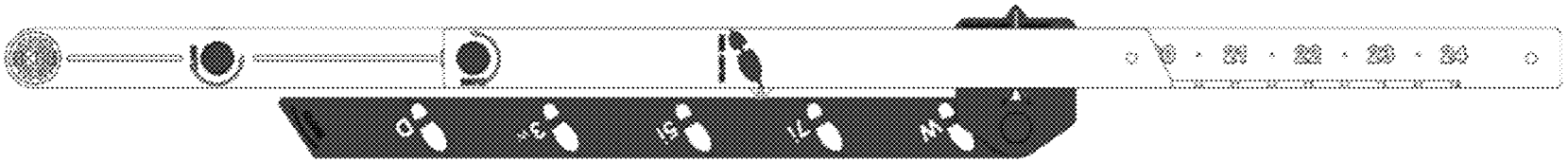
FIG. 3A depicts a top view of golf training device when in it is collapsed to be placed in the golfer's bag for storage and/or transport in embodiments of the present disclosure.
Figure 3B:
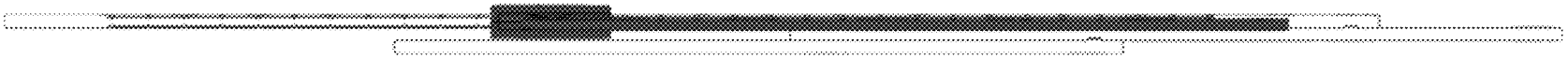
FIG. 3B depicts a side view of golf training device when in its collapsed to be placed in the golfer's bag for storage and/or transport in embodiments of the present disclosure.
Figure 4:
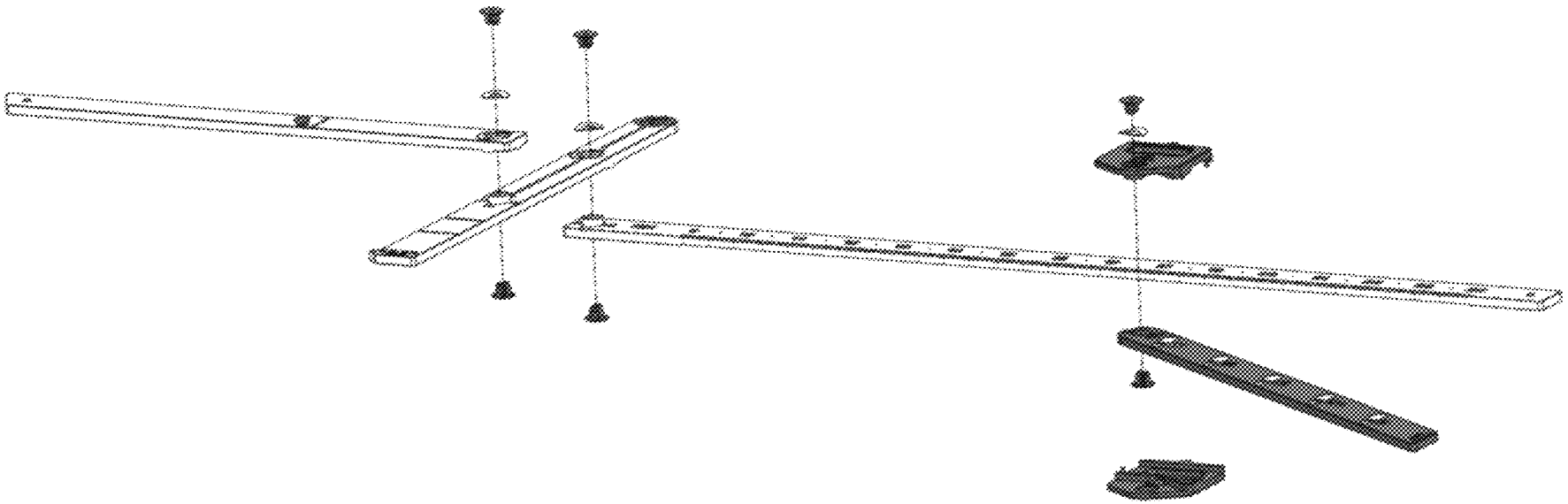
FIG. 4 depicts an exploded view of the golf training device according to an embodiment of the present disclosure.

A golf training device according to embodiments of the present disclosure may be constructed as a single piece (i.e., all components attached so there are no loose parts). However, the golf training device may be comprised of loose parts fastened together (FIG. 4) without departing from the present disclosure. FIG. 4 depicts an exploded view of the golf training device according to an embodiment of the present disclosure. While FIG. 4 depicts that the golf training device may be formed of six components attached together using a plurality of fasteners, it should be appreciated that there may be more or fewer components without departing from the present disclosure. Regardless whether constructed as a single piece or multiple pieces, the golf training device according to embodiments of the present disclosure may be collapsed or fit into a small case that can fit in a golfer's bag for storage/transport. FIG. 3A depicts a top view of golf training device when in it is collapsed to be placed in the golfer's bag for storage and/or transport in embodiments of the present disclosure. FIG. 3B depicts a side view of golf training device when in its collapsed to be placed in the golfer's bag for storage and/or transport in embodiments of the present disclosure.

Figure 1:
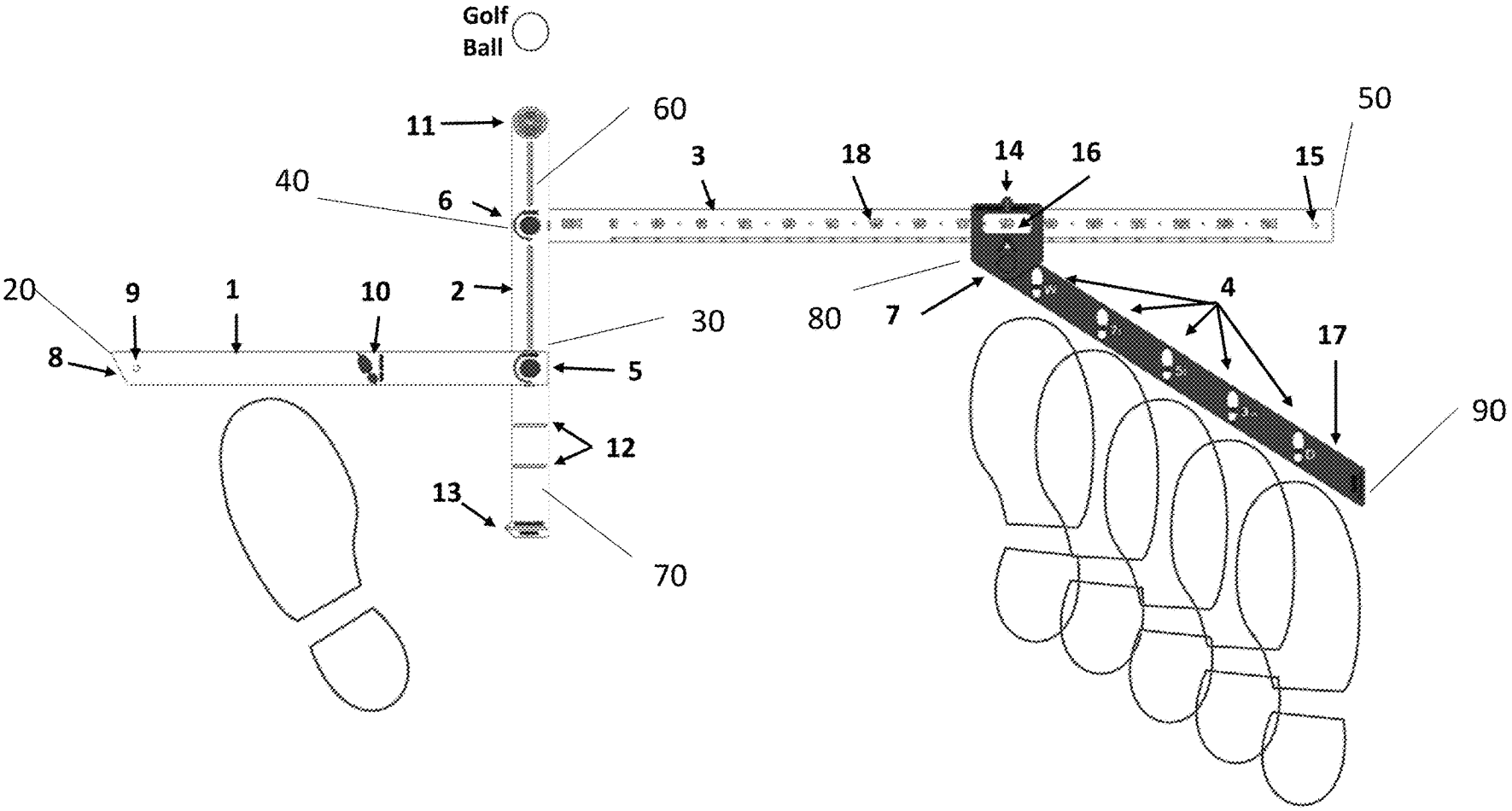
FIG. 1 depicts a golf training device according to an embodiment of the present disclosure.

FIG. 1 depicts a golf training device according to an embodiment of the present disclosure. First pivot point 5 may be on second end 30 of horizontal bar 1 opposite first end 20 to provide a means to collapse the golf training device for storage/transport when not in use. Front foot visual aid 8 and 10 may provide for correct foot and foot angle placement. A golf ball is depicted in FIG. 1 relative to alignment bar 2. Alignment bar 2, which also may be referred to as a collapsible centering guide, may provide a visual for the golfer to properly align his/her feet in a pitching or chipping setup. Second pivot point 6 may be on top half portion 60 of alignment bar 2 on first end 40 of horizontal bar 3 opposite second end 50 to provide a means to collapse the golf training device for storage/transport when not in use. Alignment bar 2 may provide a visual for the golfer to properly align his/her golf club face to be properly squared to the target line in golf stance setup. Marks 12 may be on lower half portion 70 of alignment bar 2 to provide a means for the golfer to increase the open stance when using wedges and short irons. Marks 12 may be on a lower half portion of alignment bar 2 to provide a means for the golfer to decrease the closed stance when using fairway woods or driver. Marks 11 may be on a top end of alignment bar 2 to provide an indication where a golfer may place the golf ball for proper placement.

Figure 2:
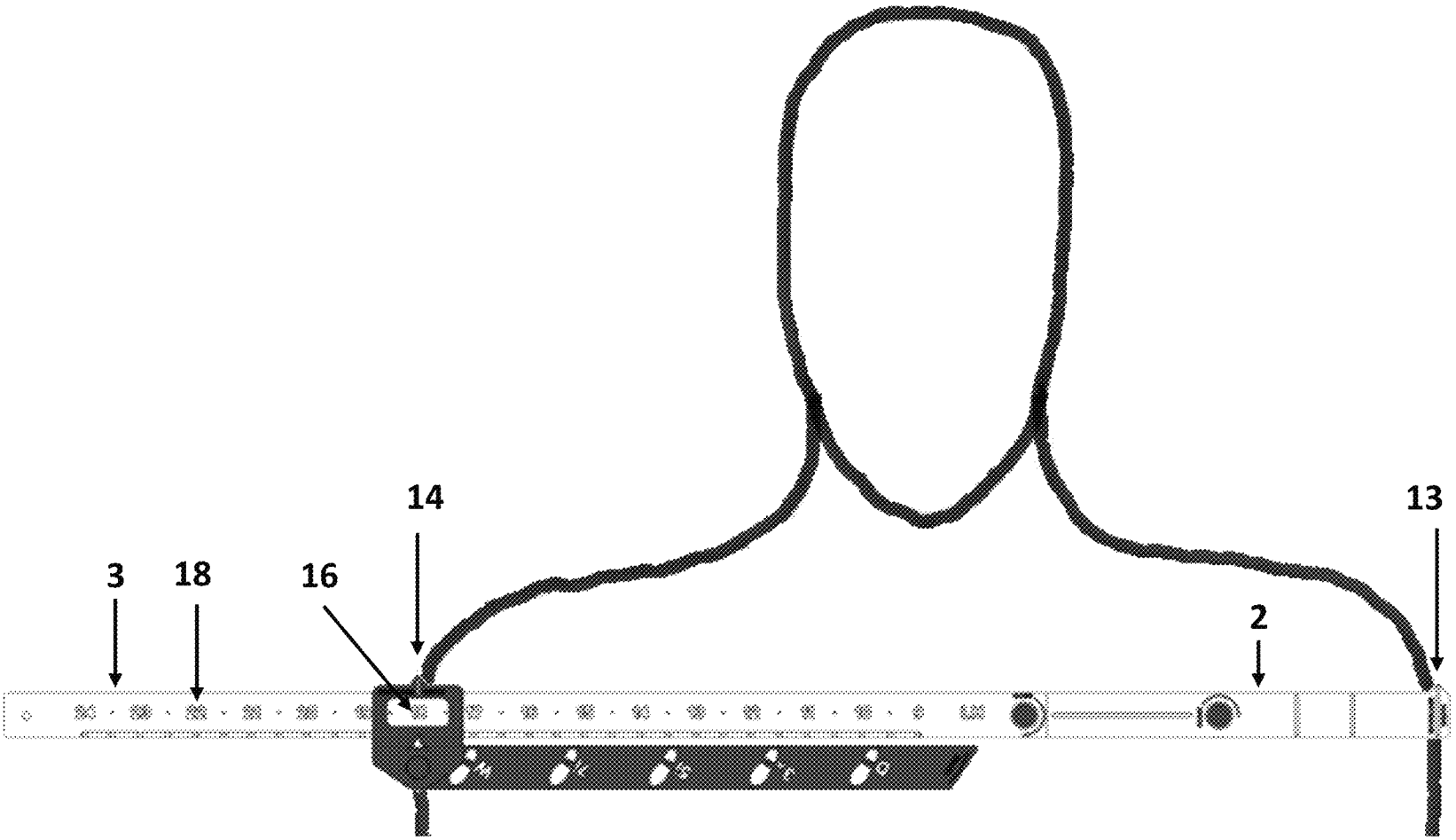
FIG. 2 depicts a golf training device when extended in its measurement mode according to an embodiment of the present disclosure.

Marks 16 depict the measurement window which may be used to set the correct golf stance width which may be based on his/her shoulder width. Marks 13 and 14 may be on bottom end 70 of alignment bar 2 and top 80 of measurement window 16 respectively to be used when golf device is extended in its measurement mode as depicted in FIG. 2.

Marks 9 and 15 may be on an end of horizontal bar 1 and 3 of the golf training device for the golfer to use to insert golf tees to secure the device in place in the ground.

Rear foot bar 17 may be extended to promote the correct placement of the rear foot relative to the club selected by the golfer. Rear foot bar 17 may have first end 80 and second end 90, wherein rear foot bar 17 is capable of being extended to promote correct placement of a rear foot of the golfer relative to his/her club. Pivot point 7 may provide a connection point between rear foot bar 17 and measurement window 16. Rear foot bar 17 may provide visual queue to promote proper inside out club swing path. Marks 4 may be provided on rear foot bar 17 extending from pivot point 7 that may be used to identify correct heel placement for wedges (W), short irons (7i), mid irons (5i), fairway woods (3w), which may include long irons or rescue clubs, and drivers (D) in embodiments of the present disclosure. While certain marks 4 are depicted on FIG. 1, it should be appreciated that more or fewer marks 4 may be provided without departing from the present disclosure.

Marks 18 depicts the measurement setting which may be set to ensure golfer stance width is properly set. Measurement window 16 may move horizontally along horizontal bar 3 to set the correct width.

Pivot point marks 5, 6, and 7 may be fastened with a mechanism to provide spring-loaded stop points to ensure proper angles are achieved when collapsed and expanded.

It should be appreciated that the golf training device according to an embodiment of the present disclosure may include marks 10, marks 12, 4, 11, and marks 18 on both sides of horizontal bar 1, alignment bar 2, horizontal bar 3, and rear foot bar 17 so that the entire device can be flipped and used by both right and left-handed golfers.

FIG. 2 depicts a golf training device according to an embodiment of the present disclosure when extended in its measurement mode. A golfer may place the golf training device up to his/her shoulders with marks 13 resting on outside of one shoulder. The golfer may slide measurement window 16 along horizonal bar 3 until marks 14 is resting on outside of alternate shoulder. The golfer may take note of marks 18 measurement number to properly set the golf training device for stance width based on his/her shoulder width.

While a physical device has been described herein, it should be appreciated that there may be embodiments of the present disclosure where an image of the physical device may be projected on the ground. In such embodiments, the image may be projected via a laser, projection device, or other similar mechanism in front of a golfer or from above the golfer, thus obviating the need for the physical device to be provided.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A golf training device comprising:

a first horizontal bar having a first end and a second end, the second end of the first horizontal bar having a first pivot point;

a second horizontal bar having a first end and a second end, the first end of the second horizontal bar having a second pivot point, the second horizontal bar further comprising a measurement window movable between the first end and the second end to set a golf stance width based on shoulder width of a golfer;

an alignment bar attached to the first horizontal bar at the first pivot point on a lower half portion of the alignment bar and attached to the second horizontal bar at the second pivot point on a top half portion of the alignment bar, and a rear tool bar attached to the measurement window of the second horizontal bar, wherein the first pivot point and the second pivot point collapse the golf training device for storage/transport when not in use.

2. The golf training device of claim 1, the first horizontal bar further comprising:

a front foot visual aid at the first end to provide for foot and foot angle placement.

3. The golf training device of claim 1, the first horizontal bar further comprising:

a front foot visual aid between the first end and the second end to provide for foot and foot angle placement.

4. The golf training device of claim 1, the alignment bar further comprising:

marks on the lower half portion of the alignment bar for a golfer to increase an open stance when using wedges and short irons or decrease a closed stance when using fairway woods or a driver.

5. The golf training device of claim 1, the alignment bar further comprising:

marks on a top end of the alignment bar, thereby providing an indication where the golfer may place a golf ball.

6. The golf training device of claim 1 further comprising:

marks on a bottom end of the alignment bar and a top of the measurement window to use when the golf training device is extended in a measurement mode.

7. The golf training device of claim 6, wherein the marks on the bottom end of the alignment bar are placed up to the golfer's shoulders with the marks resting on an outside of one shoulder and the marks at the top of the measurement window resting on an outside of an alternate shoulder of the golfer.

8. The golf training device of claim 1 further comprising:

marks on the first end of the first horizontal bar and the second end of the second horizontal bar to insert golf tees to secure the golf training device to a surface.

9. The golf training device of claim 1 wherein the rear foot bar has a first end and a second end, wherein the rear foot bar is capable of being extended to promote correct placement of a rear foot of the golfer relative to his/her club.

10. The golf training device of claim 9, the rear foot bar further comprising:

a pivot point at the first end that provides a connection point between the rear foot bar and the measurement window.

11. The golf training device of claim 10, wherein the pivot points are fastened with a mechanism to provide spring-loaded stop points to ensure proper angles when the golf training device is collapsed and expanded.

12. The golf training device of claim 9, the rear foot bar further comprising:

marks between the first end of the rear foot bar and the second end of the rear foot bar to identify correct heel placement for wedges (W), short irons (7i), mid irons (5i), fairway woods (3w), and drivers (D).

13. The golf training device of claim 1, wherein the measurement window moves horizontally along the second horizontal bar to set the shoulder width.

14. The golf training device of claim 1 further comprising: marks between the first end and the second end of the second horizontal bar that depict a measurement setting to ensure golfer stance width is properly set.

15. The golf training device of claim 1, wherein marks are on both sides of the first horizontal bar, the second horizontal bar, the alignment bar, and the rear foot bar so that the golf training device is flippable for use by both right and left-handed golfers.

* * * * *